United States Patent [19]

Hiroshige

[11] 4,448,316

[45] May 15, 1984

[54] STRAW-EQUIPPED LIQUID DRINK CONTAINER

[76] Inventor: Nakayama Hiroshige, 2-2-9, Asakusabashi, Taito-ku, Tokyo, Japan

[21] Appl. No.: 284,404

[22] Filed: Jul. 17, 1981

[30] Foreign Application Priority Data

Jul. 28, 1980 [JP] Japan ..... 55-106755[U]
Jun. 15, 1981 [JP] Japan ..... 56-87769[U]

[51] Int. Cl.[3] ..... A47G 21/18; B65D 55/16; B65D 47/04

[52] U.S. Cl. ..... 215/1 A; 215/100 R; 215/229; 220/90.2; 229/7 S; 239/33

[58] Field of Search ..... 215/1 A, 229; 220/90.2; 229/75; 239/33; 222/211, 522

[56] References Cited

U.S. PATENT DOCUMENTS

| | | | |
|---|---|---|---|
| 942,306 | 12/1909 | Clarke | 215/1 A |
| 2,066,121 | 12/1936 | Morris | 215/229 |
| 2,815,879 | 12/1957 | Hermes | 215/229 X |
| 3,776,458 | 12/1973 | Chunga | 215/1 A X |
| 3,840,153 | 10/1974 | Devlin | 215/1 A X |

FOREIGN PATENT DOCUMENTS

| | | | |
|---|---|---|---|
| 152594 | 12/1955 | Sweden | 215/1 A |

*Primary Examiner*—William Price
*Assistant Examiner*—Sue A. Weaver
*Attorney, Agent, or Firm*—Holman & Stern

[57] ABSTRACT

A straw-equipped liquid drink container comprising a flexible straw accommodated in the container in such a manner that upon removal of the seal cover of the container, one end portion of the straw may spring out of the container by the force of a spring acting on the straw in the container to thus enable one to drink the liquid quickly and very easily.

3 Claims, 8 Drawing Figures

STRAW-EQUIPPED LIQUID DRINK CONTAINER

BACKGROUND OF THE INVENTION

1. Field of the Invention

This invention relates to a straw-equipped liquid drink container, wherein the container is equipped with a straw in such a manner that the straw is insertable into and/or withdrawable from the container as required.

This invention is suitable especially for sports drinks to be taken mainly by those who are playing sports.

2. Description of the Prior Art

Conventionally, there has been no drink container equipped with a straw. When one desires to drink the liquid contained in a container such as a bottle and the like he takes the container up to his mouth and drinks the liquid direct from the mouth of the container, or he inserts a straw into the container and drinks the liquid through the straw. Thus, it may not be possible for him to drink quickly and smoothly.

BRIEF SUMMARY OF THE INVENTION

The object of the present invention is therefore to provide a straw-equipped liquid drink container with a seal cap openable by one touch to allow one end portion of the straw to spring out through the mouth or opening of the container to thus enable one to drink the liquid quickly and very easily and also to force the straw into the container through the mouth or opening and to seal it again.

The straw-equipped drink container of the present invention is characterized in that the straw accommodated in the container may spring out of the container by the action of a spring instantaneously when the seal cap of the container is removed from the container.

BRIEF DESCRIPTION OF THE DRAWING

The accompanying drawings show several embodiments of a straw-equipped liquid drink container according to this invention, wherein.

DETAILED DESCRIPTION OF THE INVENTION

Figure 1:
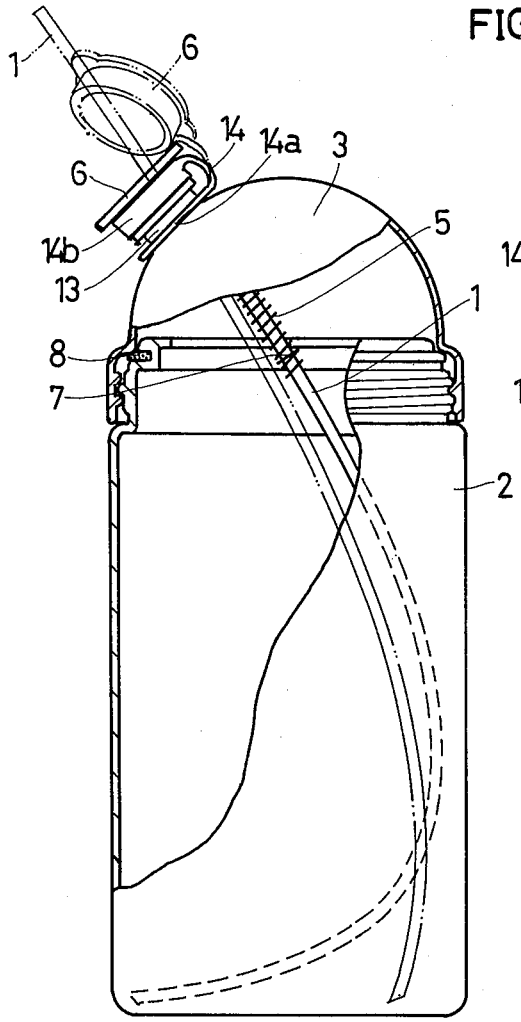
FIG. 1 is an elevational view of a first embodiment of this invention shown partly cut away.
Figure 3:
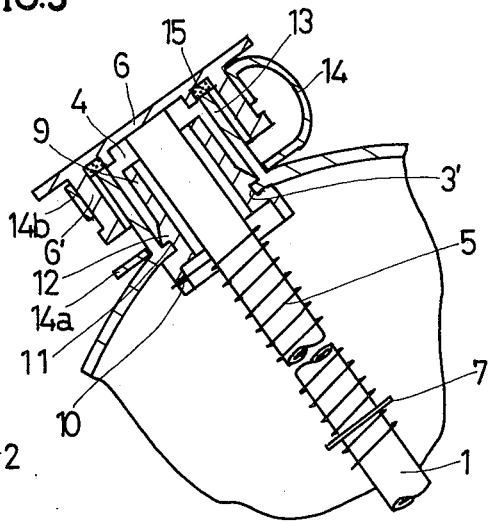
FIG. 3 is a cross sectional view of the top portion of the container of FIGS. 1 and 2.
Figure 4:
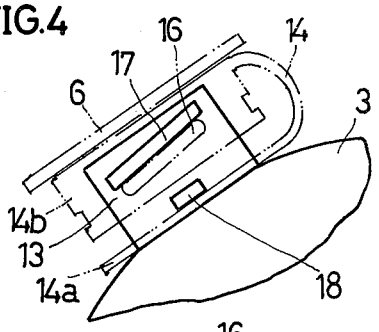
FIG. 4 is an enlarged side elevational view of part of the top portion of the container of FIG. 1.
Figure 5:
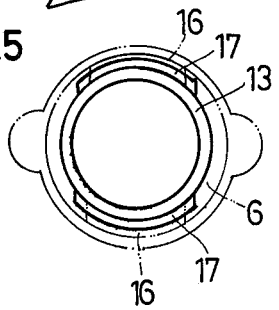
FIG. 5 is a plan view of the mouth of the container of FIG. 1.
Figure 2:
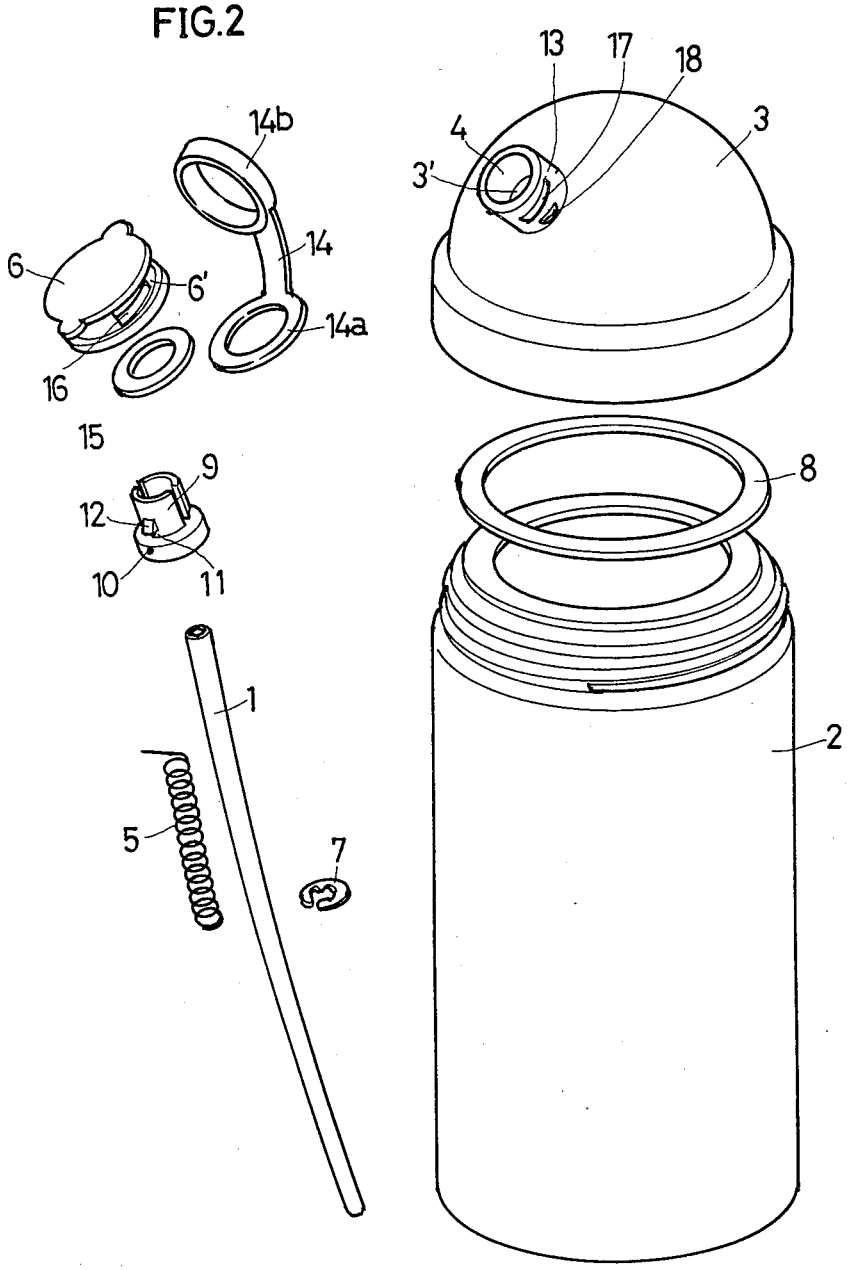
FIG. 2 is an exploded perspective view of the embodiment of FIG. 1.

In the first embodiment shown in FIGS. 1 to 5, 1 is a straw, 2 indicates a liquid container, and 3 is a cap of the container. The liquid container 2 accommodating the straw 1 made of flexible material, or the cap 3 is formed with a mouth or opening 4 for projecting the straw 1 therethrough, and to this mouth or opening 4 is closably and openably hinged a seal cap 6 which may force the straw 1 into the liquid container 2 against the force of a coil spring 5 acting on the straw 1 in the container.

A snap ring 7 is inserted over the straw 1 and one end of the coil spring 5 wound around the straw 1 is engaged with the snap ring 7 and the other end of the coil spring 5 is inserted into a slit 10 in a split intermediate tube 9 inserted into the mouth 4 formed in the cap 3 which is screwed on to the liquid container 2 with a sealing ring 8 therebetween.

The intermediate tube 9 has a neck portion 11 and a slanted projection 12 thereon is pushed out against the opening 3' of the cap 3 and the neck portion 11 is securely inserted into the opening 3'. The mouth 4 is formed integrally with a tubular portion 13 and the mouth 4 is covered with a seal cover 6. 14 is a support member for the seal cover 6 and has ring portions **14*a* and 14*b* such that the ring portion 14*a* is loosely inserted over the tubular portion 13 and the other ring portion 14*b* is loosely inserted around the peripheral face 6' of the seal cover 6 to prevent the seal cover 6 from falling off when opened and becoming lost. 15 is a packing disposed in the seal cover 6**.

On the inner face of peripheral part 6' of the seal cover 6 there is provided an arcuate ledge 16 which may engage with the underside of arcuate ledge 17 formed on the tubular portion 13 of the cap 3 so as to lock the seal cover 6, while the seal cover 6 can be opened by disengaging both ledges 16 and 17 by rotating the seal cover 6.

18 is a catching projection for the support ring portion **14*a* provided on the tubular portion 13. The mouth 4 through which may extend out the straw 1 can be formed direct by on the liquid container 2 without providing the cap 3**.

Figure 6:
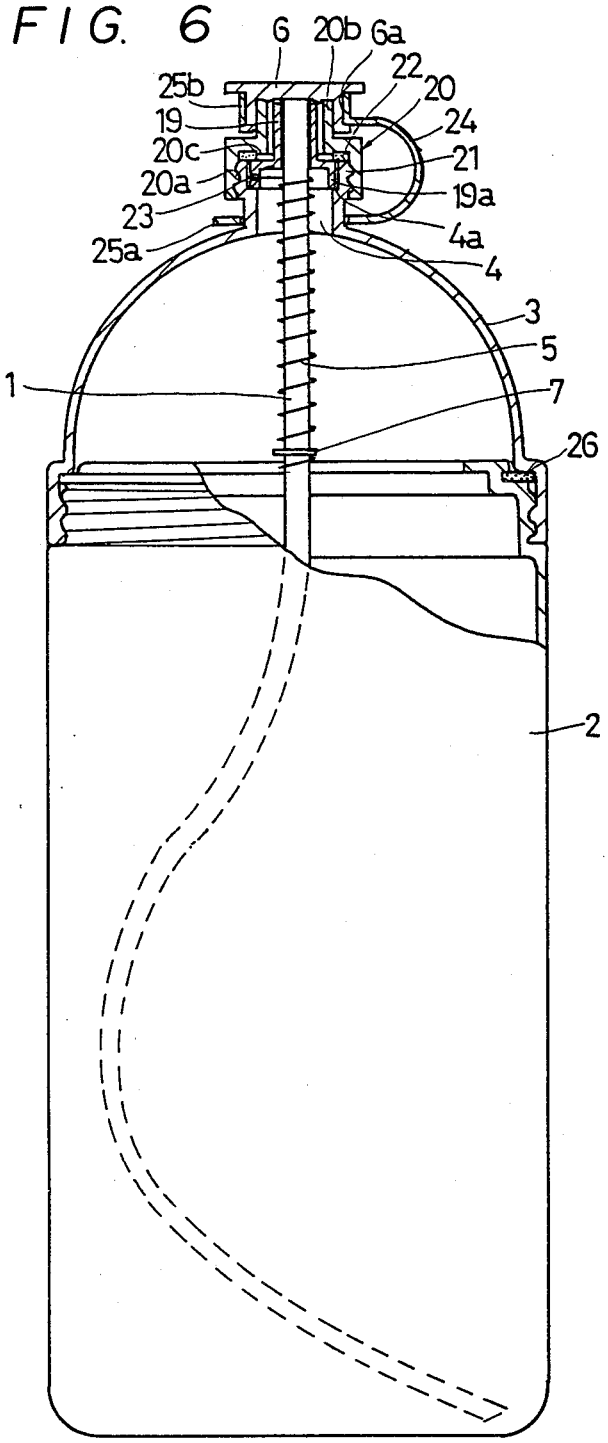
FIG. 6 is an elevational and partly sectional view of a second embodiment of this invention.
Figure 7:
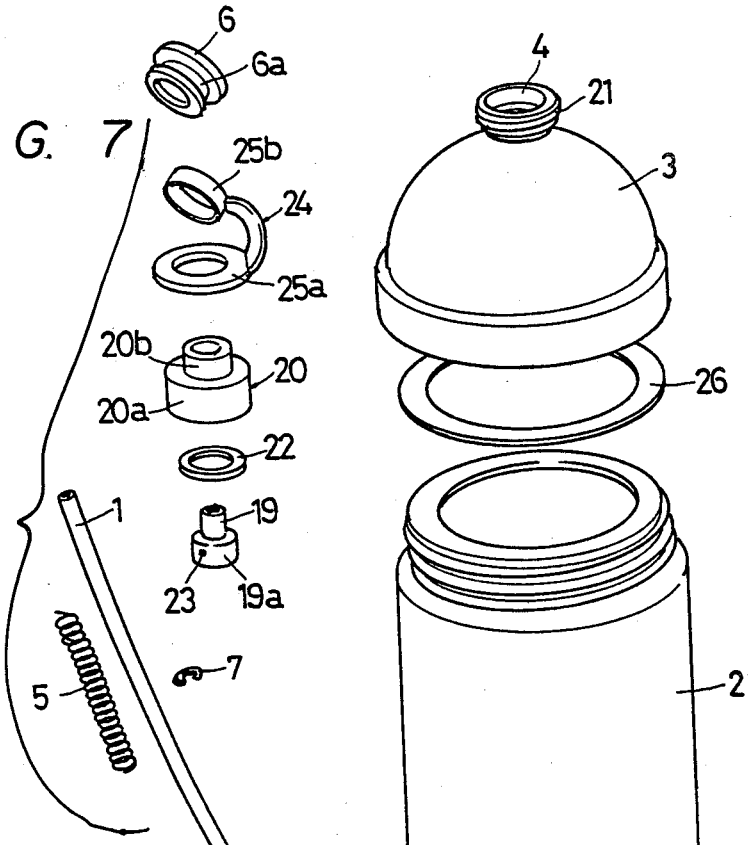
FIG. 7 is an exploded perspective view of the second embodiment of FIG. 6.

Now, in the second embodiment shown in FIGS. 6 and 7, the invention comprises a straw-equipped intermediate tube 19 inserted in the step part **4*a* of the mouth 4 through which may extend the straw 1, a guide tube 20 consisting of large and small tubular portions 20*a* and 20*b* respectively and step part 20*c* between both parts 20*a*, 20*b*, the larger diameter part 20*a* of the guide tube 20 being screwed into the tubular portion 21 forming the mouth 4, the straw-equipped intermediate tube 19 being fixed and squeezed from below and above by the step part 4*a* of the mouth 4 and the step part 20*c* of the guide tube 20 respectively, the seal cover 6 pressing the straw 1 down into the liquid container 2 against the force of the coil spring 5 acting on the straw 1 contained in the liquid container 2 being inserted into the guide tube 20, snap ring 7 being inserted on the straw 1, and one end of the coil spring 5 wound around the straw 1 being fixed to the snap ring 7 and the other end of the coil spring 5 being fixed to the larger-diameter portion 19*a* of the intermediate tube 19 accommodated in the tubular portion 21 formed in the cap 3 of the liquid container 2 and sealed by a packing member 22**.

23 is a slit into which is inserted the end of the coil spring 5. 24 is a support member for the seal cover 6 and has ring portions **25*a*, 25*b*, one ring portion 25*a* being loosely inserted over the tubular portion 21 and the other ring portion 25*b* being loosely inserted on the peripheral surface 6*a* of the seal cover 6 so as to prevent the cover from falling off when opened. 26 is a packing disposed between the cap 3 and the liquid container 2**.

Figure 8:
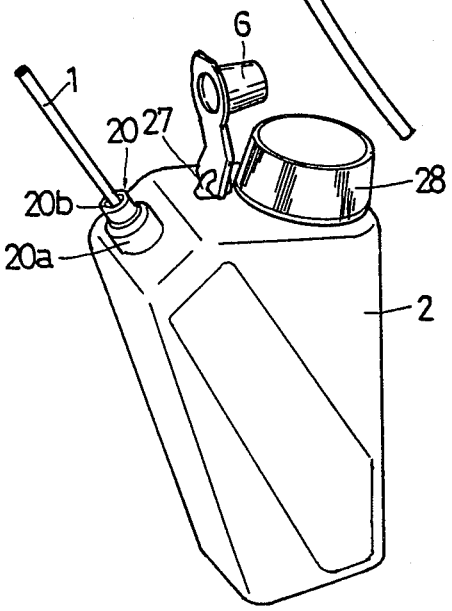
FIG. 8 is a perspective view of a third embodiment of the invention.

FIG. 8 shows a liquid container 2 according to the third embodiment of the present invention having no cap 3 and the seal cover 6 is mounted on the container 2 by means of a connecting hook 27, and the other interior construction is similar to that of the embodiment shown in FIG. 1 except for a liquid supply cap 28 separately provided.

With the present invention constructed as described above, one end of the straw 1 may spring out of the mouth 4 by the controlling force of the coil spring 5 upon a single action of removing the seal cover 6. Accordingly, it may be possible for one to drink the liquid quickly and also, when the straw is pushed into the container and the cover 6 is fitted to the mouth the straw may be accommodated within the container 2 so that no hindrance will occur thereby.

Moreover, when the container is constructed as shown in FIGS. 6 and 7, the straw 1 can be removed from the container by removing the guide tube 19 screwed in the tubular portion 21 of the mouth 4 so that the straw-equipped intermediate tube 19 may readily be removed when replacing and/or cleaning the straw 1 and the straw will not fall into the container during the use thereof.

I claim:

1. A straw-equipped liquid drink container comprising, a liquid container having a mouth, a semispherical cap screwed over said mouth of said container, a tubular projecting opening on the upper side wall surface of said cap, a straw made of flexible material disposed in said container and protruding in use through said opening, a seal cap, means for removably screwing said seal cap onto said tubular projecting opening comprising a tubular extension on said seal cap to fit over said tubular projecting opening, a pair of internal screw thread segments provided on the opposite sides of the internal periphery of said tubular extension of said seal cap, a pair of external screw thread segments provided on the external periphery of said tubular projecting opening, and gaps provided between said pairs of thread segments for enabling said segments to pass therethrough when said seal cap is placed in the closing position, said seal cap forcing the protruding part of said straw into said liquid container and retaining it therein when said seal cap is in the closed position, a support member connecting said seal cap to said projecting tubular opening, a snap ring inserted onto said straw, and a coil spring fixedly attached at one end to said snap ring and at the other end to said tubular opening so that said straw is resiliently urged by said spring into the protruding position to project out of said tubular opening by flexure of said straw as well as the spring action of said spring when said seal cap is opened.

2. A straw-equipped liquid drink container comprising, a liquid container having a mouth, a semispherical cap screwed over said mouth of said container, a tubular projecting opening on the upper side wall surface of said cap, an internal peripheral edge on said semispherical cap at said opening in the upper side wall thereof, an intermediate tubular member disposed within said tubular opening, a flange on said intermediate tubular member adapted to engage with one side of said internal peripheral edge and at least one projection on said intermediate tubular member adapted to engage with the other side of said peripheral edge, a straw made of flexible material disposed in said container and protruding in use through said opening, a seal cap, means for removably screwing said seal cap onto said tubular opening, said seal cap forcing the protruding part of said straw into said liquid container and retaining it therein when said seal cap is in the closed position, a support member connecting said seal cap to said projecting tubular opening, a snap ring inserted onto said straw, and a coil spring fixedly attached at one end to said snap ring and at the other end to said flange so that said straw is resiliently urged by said spring into the protruding position to project out of said tubular opening by flexure of said straw as well as the spring action of said spring when said seal cap is opened.

3. A straw-equipped liquid drink container comprising, a liquid container having a mouth, a semispherical cap screwed over said mouth of said container, a tubular projecting opening on the upper side wall surface of said cap, a straw made of flexible material disposed in said container and protruding in use through said opening, a seal cap, means for removably screwing said seal cap onto said tubular opening, said seal cap forcing the protruding part of said straw into said liquid container and retaining it therein when said seal cap is in the closed position, a support member connecting said seal cap to said projecting tubular opening, a snap ring inserted onto said straw, a coil spring fixedly attached at one end to said snap ring and at the other end to said tubular opening so that said straw is resiliently urged by said spring into the protruding position to project out of said tubular opening by flexure of said straw as well as the spring action of said spring when said seal cap is opened, a guide tube threadedly connected to said tubular projecting opening having a large diameter portion and a small diameter portion forming a step portion therebetween, said large diameter portion having internal screw threads for connecting to said tubular projecting opening and said small diameter portion having said seal cap removably attached thereto, an annular reduced shoulder on the inner periphery of said tubular projecting opening, an intermediate tube member disposed within said guide tube, and a flange portion in said intermediate tube member squeezed between said reduced shoulder and said step portion to retain said intermediate tube member in place, said straw protruding through said intermediate tube member.

* * * * *